US011056073B2

(12) United States Patent
Chen

(10) Patent No.: US 11,056,073 B2
(45) Date of Patent: Jul. 6, 2021

(54) DISPLAY DEVICE AND REFERENCE VOLTAGE GENERATION METHOD

(71) Applicants: HKC Corporation Limited, Shenzhen (CN); Chongqing HKC Optoelectronics Technology Co.,ltd., Chongqing (CN)

(72) Inventor: Yu-jen Chen, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 391 days.

(21) Appl. No.: 16/090,852

(22) PCT Filed: Dec. 12, 2017

(86) PCT No.: PCT/CN2017/115715
§ 371 (c)(1),
(2) Date: Oct. 3, 2018

(87) PCT Pub. No.: WO2018/192240
PCT Pub. Date: Oct. 25, 2018

(65) Prior Publication Data

US 2021/0035522 A1 Feb. 4, 2021

(30) Foreign Application Priority Data

Apr. 19, 2017 (CN) ..... 201710258778.6

(51) Int. Cl.
*G09G 3/36* (2006.01)
*G05F 3/24* (2006.01)

(52) U.S. Cl.
CPC ..... *G09G 3/3696* (2013.01); *G05F 3/24* (2013.01); *G09G 3/3648* (2013.01); *G09G 2310/08* (2013.01)

(58) Field of Classification Search
CPC ..... G09G 3/3696; G09G 3/3648; G09G 2310/08; G05F 3/24
See application file for complete search history.

(56) References Cited

U.S. PATENT DOCUMENTS 7,847,718 B2 12/2010 Ishii et al.
8,120,598 B2 2/2012 Shin et al.
(Continued)

FOREIGN PATENT DOCUMENTS

CN 1808552 7/2006
CN 1980068 6/2007
(Continued)

OTHER PUBLICATIONS

International search report dated Mar. 15, 2018 from corresponding application No. PCT/CN2017/115715.
(Continued)

*Primary Examiner* — Amare Mengistu
*Assistant Examiner* — Jennifer L Zubajlo
(74) *Attorney, Agent, or Firm* — Hauptman Ham, LLP

(57) ABSTRACT

The present application discloses a display device and a reference voltage generation method. The display device includes a display area, a fan-out area, and a reference voltage generation circuit formed in the fan-out area. The reference voltage generation circuit includes a multi-voltage conversion module configured to: input a first direct current voltage and a second direct current voltage, and output multiple third direct current voltages having different voltage values; a latch module, configured to: input multiple latch signals and gating signals, and output corresponding
(Continued)

switch control signals according to the input multiple latch signals and gating signals; a gating switch matrix, having a plurality of switch branches for controlling output of the multiple third direct current voltages, configured to turn on corresponding switch branches according to the switch control signals when the switch control signals are received, to output the third direct current voltages having corresponding voltage values.

9 Claims, 3 Drawing Sheets

(56) References Cited

U.S. PATENT DOCUMENTS

| | | | | |
|---|---|---|---|---|
| 8,760,443 | B2 | 6/2014 | Shin et al. | |
| 2006/0164354 | A1* | 7/2006 | Lee | G09G 3/3648 345/89 |
| 2007/0126689 | A1 | 6/2007 | Ishii et al. | |
| 2007/0182693 | A1 | 8/2007 | Kwon et al. | |
| 2008/0079701 | A1 | 4/2008 | Shin et al. | |
| 2012/0146983 | A1 | 6/2012 | Shin et al. | |
| 2018/0268764 | A1* | 9/2018 | Huang | G09G 3/3696 |

FOREIGN PATENT DOCUMENTS

| | | |
|---|---|---|
| CN | 105513549 | 4/2016 |
| CN | 106157913 | 11/2016 |
| CN | 107123401 | 9/2017 |
| JP | 2003-280596 | 10/2003 |

OTHER PUBLICATIONS

Office Action dated Nov. 23, 2017 from corresponding application No. CN 201710258778.6.

* cited by examiner

| B1 | B2 | B3 | VCC3 |
|---|---|---|---|
| H | H | H | V1 |
| L | H | H | V2 |
| H | L | H | V3 |
| H | H | L | V4 |
| L | L | H | V5 |
| L | H | L | V6 |
| H | L | L | V7 |
| L | L | L | V8 |

DISPLAY DEVICE AND REFERENCE VOLTAGE GENERATION METHOD

RELATED APPLICATIONS

The present application is a National Phase of International Application Number PCT/CN2017/115715, filed Dec. 12, 2017, and claims the priority of China Application No. 201710258778.6, filed Apr. 19, 2017.

TECHNICAL FIELD

The present application relates to the technical field of electrical circuits, and in particular, to a display device and a reference voltage generation method.

BACKGROUND

At present, a thin-film-transistor liquid crystal display (TFT-LCD) is currently one of the widely applied and major display devices of flat panel display. Display devices already become essential display platforms for modern IT and video electronic devices and the like.

A display device is driven by a voltage. During display work, a liquid crystal deflection reference voltage VCOM needs to be provided for the deflection of liquid crystal molecules in a panel. In the prior art, the reference voltage VCOM may be generated by a digital voltage regulator (DVR) or a mechanical voltage regulator (VR) on a circuit board connected to a panel of the display device and output to the panel of the display device. However, the DVR and the mechanical VR have high manufacturing costs, resulting in high overall production costs of an electronic device, which adversely affects popularization and use of the display device.

SUMMARY

A main objective of the present application is to provide a display device and a reference voltage generation method, so that a structure of a display device can be used to obtain an adjustable reference voltage.

To achieve the foregoing objective, the present application provides a display device. The display device includes a display area, a fan-out area, and a reference voltage generation circuit formed in the fan-out area. The reference voltage generation circuit includes:

a multi-voltage conversion module, configured to: input a first direct current voltage and a second direct current voltage, and output multiple third direct current voltages having different voltage values;

a latch module, configured to: input multiple latch signals and gating signals, and output corresponding switch control signals according to the input multiple latch signals and gating signals; and a gating switch matrix, having a plurality of switch branches for controlling output of the multiple third direct current voltages, and configured to: when the switch control signals are received, turn on corresponding switch branches according to the switch control signals, so as to output the third direct current voltages having corresponding voltage values.

Optionally, the latch module includes a plurality of first input ends, and first input ends and second input ends of the multi-voltage conversion module are respectively configured to input the first direct current voltage and the second direct current voltage;

each of the switch branches includes an input end, an output end, and a controlled end;

the latch module includes the plurality of first input ends, a plurality of second input ends, and a plurality of output ends; and the first input end and the second input end of the multi-voltage conversion module are respectively configured to input the first direct current voltage and the second direct current voltage, and a plurality of output ends of the multi-voltage conversion module are connected to the input ends of the plurality of switch branches in one-to-one correspondence; the output ends of the plurality of switch branches are configured to output the third direct current voltages having corresponding voltage values; and the plurality of first input ends of the latch module are configured to input latch signals, and the plurality of second input ends of the latch module are configured to input gating signals, and the plurality of output ends of the latch module are connected to the controlled ends of the plurality of switch branches in one-to-one correspondence.

Optionally, when the latch signal is a first level signal, a switch control signal output by an output end of the latch module is a gating signal input this time, and when the latch signal is a second level signal, the output end maintains a previous switch-control-signal output state, and a gating signal at this time fails.

Optionally, the multi-voltage conversion module includes N voltage divider resistors, and the voltage divider resistors have a same resistance value and are sequentially connected in serial between first input ends and second input ends of the multi-voltage conversion module.

Optionally, the N voltage divider resistors equally divide a difference value between the first direct current voltage and the second direct current voltage into N+1 voltage values and output the N+1 voltage values as the third direct current voltages.

Optionally, the quantity of the switch branches is N+1, and each of the N+1 switch branches has M serially connected switching tubes, so as to form the gating switch matrix having M rows and (N+1) columns, where $N=2^M-1$.

Optionally, the latch module includes M latches disposed corresponding to the M rows of the gating switch matrix, and output ends of the latches are connected to controlled ends of the switching tubes that are located in a same row as the gating switch matrix in one-to-one correspondence.

Optionally, the latches output the corresponding switch control signals by using a binary code principle to control the switching tubes in the corresponding switch branches to be turned on.

Optionally, the display device further includes a source-chip on film (S-COF) and a gate-chip on film (G-COF), and the S-COF and the G-COF are connected to the display area.

The present application further provides a reference voltage generation method, including the following steps:

controlling a multi-voltage conversion module to input a first direct current voltage and a second direct current voltage and output multiple third direct current voltages having different voltage values after the input first direct current voltage and second direct current voltage are converted;

controlling a latch module to input multiple latch signals and gating signals and output corresponding switch control signals according to the input multiple latch signals and gating signals; and when the switch control signals are received, turning on, by a gating switch matrix, corresponding switch branches in the gating switch matrix according to the switch control signals, so as to output the third direct current voltages having corresponding voltage values, where the third direct current voltages are reference voltages.

Optionally, when the latch signal is a first level signal, a switch control signal output by an output end of the latch module is a gating signal input this time, and when the latch signal is a second level signal, the output end maintains a previous switch-control-signal output state, and a gating signal at this time fails.

Optionally, the multi-voltage conversion module uses N voltage divider resistors to equally divide a difference value between the first direct current voltage and the second direct current voltage into N+1 voltage values and output the N+1 voltage values as the third direct current voltages.

Optionally, N+1 switch branches are used for implementation, and each of the N+1 switch branches has M serially connected switching tubes, so as to form the gating switch matrix having M rows and (N+1) columns, where $N=2^M-1$.

Optionally, the latch module uses M latches to respectively and correspondingly control corresponding rows of a plurality of switch branches to turn on/off switching tubes at the same locations.

The present application further provides a display device. The display device includes a display area, a fan-out area, and a reference voltage generation circuit formed in the fan-out area. The reference voltage generation circuit includes:

a multi-voltage conversion module, configured to: input a first direct current voltage and a second direct current voltage, and output multiple third direct current voltages having different voltage values;

a latch module, configured to: input multiple latch signals and gating signals, and output corresponding switch control signals according to the input multiple latch signals and gating signals; and a gating switch matrix, having a plurality of switch branches for controlling output of the multiple third direct current voltages, and configured to: when the switch control signals are received, turn on corresponding switch branches according to the switch control signals, so as to output the third direct current voltages having corresponding voltage values, where the multi-voltage conversion module includes N voltage divider resistors, and the N voltage divider resistors are resistors that are in the fan-out area, are formed by using a same process, and have a same resistance value.

The present application further provides an electronic device, including a circuit board and the foregoing display device. The circuit board is connected to a display area through a fan-out area of the display device. The display device includes the display area, the fan-out area, and a reference voltage generation circuit formed in the fan-out area. The reference voltage generation circuit includes: a multi-voltage conversion module, configured to: input a first direct current voltage and a second direct current voltage, and output multiple third direct current voltages having different voltage values; a latch module, configured to: input multiple latch signals and gating signals, and output corresponding switch control signals according to the input multiple latch signals and gating signals; and a gating switch matrix, having a plurality of switch branches for controlling output of the multiple third direct current voltages, and configured to: when the switch control signals are received, turn on corresponding switch branches according to the switch control signals, so as to output the third direct current voltages having corresponding voltage values.

In the present application, the multi-voltage conversion module is disposed to equally divide a difference value between the first direct current voltage and the second direct current voltage into multiple different voltage values and output the multiple different voltage values to form the corresponding third direct current voltages, so as to form corresponding third direct current voltages. The latch module is disposed, multiple latch signals and gating signals are input, and corresponding switch control signals are output according to the input multiple latch signals and gating signals, to control the gating switch matrix to turn on corresponding switch branches according to the switch control signals, so as to output the third direct current voltages having corresponding voltage values. In this case, a worker only needs to examine a current display status of a liquid crystal panel and adjust the third direct current voltages output by the switch branches according to a flickering degree of the liquid crystal panel. When the flickering degree is minimum, the panel has the optimal performance.

In the display device of the present application, structures such as a multi-voltage conversion module, a latch module, and a gating switch matrix in a fan-out area are used to form a reference voltage generation circuit. The circuit has a simple structure and is easy to implement, thereby reducing high overall production costs of an electronic device. A reference voltage that can be generated by the reference voltage generation circuit without using a DVR and a mechanical VR is adjustable, and a display effect of a liquid crystal panel is more desirable. In addition, because the reference voltage is generated at the display device, it is not necessary to consider a correspondence problem in assembling a control board (C-board) and the liquid crystal panel, thereby facilitating subsequent transport and mounting.

BRIEF DESCRIPTION OF DRAWINGS

To describe the technical solutions in the embodiments of the present application or in the prior art more clearly, the following briefly describes the accompanying drawings required for describing the embodiments or the prior art. Apparently, the accompanying drawings in the following description show some embodiments of the present application, and a person of ordinary skill in the art may still derive other drawings from structures shown in these accompanying drawings without creative efforts.

The implementation of the purpose, functional features, and advantages of the present application will be further described in conjunction with the embodiments and the accompanying drawings.

DETAILED DESCRIPTION

The following clearly and completely describes the technical solutions in the embodiments of the present application with reference to the accompanying drawings in the embodiments of the present application. Apparently, the described embodiments are merely a part rather than all of the embodiments of the present application. All other embodiments obtained by a person of ordinary skill in the art based on the embodiments of the present application without creative efforts shall fall within the protection scope of the present application.

It should be noted that all the directional indications (such as "upper", "lower", "left", "right", "front", "rear", etc.) in the embodiments of the present application are merely used to explain a relative position relationship, motion situations, and the like of the components in a specific gesture (as shown in the figures). If the specific gesture changes, the directivity indication also changes accordingly.

Moreover, the terms such as "first", "second", and the like described in the embodiments of the present application are used herein only for the purpose of description and are not intended to indicate or imply relative importance, or implicitly indicate the number of the indicated technical features. Therefore, features defined by "first" and "second" may explicitly or implicitly include at least one of the features. Furthermore, the technical solutions between the various embodiments may be combined with each other, but must be on the basis that the combination thereof can be implemented by a person of ordinary skill in the art. In case of a contradiction with the combination of the technical solutions or a failure to implement the combination, it should be considered that the combination of the technical solutions does not exist, and is not within the protection scope of the present application.

The present application provides a display device, applicable to a video electronic device such as a computer, a television, and a mobile phone.

Figure 1:
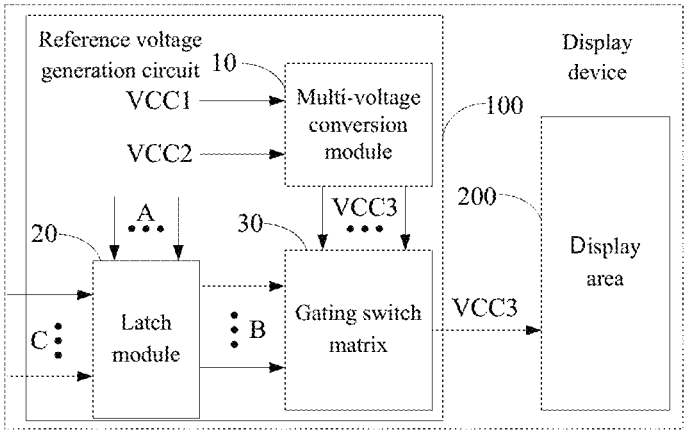
FIG. 1 is a block diagram of a display device in an embodiment of the present disclosure.

Referring to FIG. 1, in an embodiment of the present application, the display device includes a fan-out area 100, a display area 200, and a reference voltage generation circuit (not shown) formed in the fan-out area 100.

A system motherboard on an electronic device connects an R/G/B compression signal, a control signal, and a power voltage to a connector of a C-board through a lead. Data such as the R/G/B compression signal, the control signal, and the power voltage is processed by a timing controller (TCON) IC on the C-board and is transmitted to a circuit board through a flexible flat cable (FFC). The circuit board is connected to the display area 200 via an S-COF and a G-COF in the fan-out area 100, to enable the display area 200 to obtain a required working power voltage and work according to the control signal.

It should be understood that the display area 200 of the display device is driven by a voltage. During displaying, a reference voltage VCOM is required. Because of process instability display areas 200 of display devices, that is liquid crystal panels, have different optimal reference voltages, which need to be adjusted according to actual characteristics of the liquid crystal panels. Generally, a reference voltage is mostly generated by a DVR or a mechanical VR on the circuit board or the C-board and is further output to the liquid crystal panel, so as to drive the liquid crystal panel. However, costs of the DVR and the mechanical VR are very high, resulting in high overall production costs of the electronic device, which adversely affects popularization and use of the display device. In addition, when the reference voltage is generated by the C-board, for convenient transport during delivery, the C-board and the liquid crystal panel are separately packed and delivered. As a result, a user may choose a liquid crystal panel and a C-board that do not correspond to each other. Consequently, a corresponding reference voltage of the liquid crystal panel in the C-board is not an optimal value, and further the picture flickers and a display effect is undesirable. In this embodiment, for this condition, a reference voltage generation circuit formed in the fan-out area 100 of the display device is provided. The reference voltage generation circuit is formed in the fan-out area 100, and the generated reference voltage is adjustable.

In this embodiment, the reference voltage generation circuit includes a multi-voltage conversion module 10, a latch module 20, and a gating switch matrix 30.

Specifically, first input ends and second input ends of the multi-voltage conversion module 10 are respectively configured to input a first direct current voltage VCC1 and a second direct current voltage VCC2. A plurality of output ends of the multi-voltage conversion module 10 are connected to input ends of the plurality of switch branches in one-to-one correspondence. Output ends of the plurality of switch branches are configured to output third direct current voltages VCC3 having corresponding voltage values. A plurality of first input ends of the latch module 20 are configured to input latch signals. A plurality of second input ends of the latch module 20 are configured to input gating signals. A plurality of output ends of the latch module 20 are connected to controlled ends of the plurality of switch branches in one-to-one correspondence.

The multi-voltage conversion module 10 is configured to: input the first direct current voltage VCC1 and the second direct current voltage, and output the multiple third direct current voltages VCC3 having different voltage values. The first direct current voltage VCC1 and the second direct current voltage are input via the circuit board, and are respectively an upper limit and a lower limit of adjustment of the reference voltage. The multi-voltage conversion module 10 equally divides a difference value between the first direct current voltage VCC1 and the second direct current voltage into multiple different voltage values and outputs the multiple different voltage values to form corresponding third direct current voltages VCC3.

The latch module 20 is configured to: input multiple latch signals and gating signals, and output corresponding switch control signals according to the input multiple latch signals and gating signals; when the latch signal is a logic level H (high level), a switch control signal output by an output end B of the latch module 20 is a gating signal input this time, and when the latch signal is a logic level L (low level), the output end maintains a previous switch-control-signal output state, and a gating signal at this time fails.

The gating switch matrix 30 has a plurality of switch branches for controlling the output of the multiple third direct current voltages VCC3, and is configured to: turn on corresponding switch branches according to the switch control signals when the switch control signals are received, so as to output the third direct current voltages VCC3 having corresponding voltage values. When corresponding switch branches are turned on, the switch branches output the third direct current voltages VCC3 having corresponding voltage values of the multi-voltage conversion module 10 at this time.

In the present application, the multi-voltage conversion module 10 is disposed to equally divide a difference value between the first direct current voltage VCC1 and the second direct current voltage into multiple different voltage values and output the multiple different voltage values, so as to form corresponding third direct current voltages VCC3. The latch module 20 is disposed, multiple latch signals and gating signals are input, and corresponding switch control signals according to the input multiple latch signals and gating signals are output, to control the gating switch matrix 30 to turn on corresponding switch branches according to the switch control signals, so as to output the third direct current voltages VCC3 having corresponding voltage values. In this case, a worker only needs to examine a current display status of a liquid crystal panel and adjust the third direct current voltages VCC3 output by the switch branches according to a flickering degree of the liquid crystal panel. When the flickering degree is minimum, the panel has the optimal performance. When the liquid crystal panel has optimal display at this time, the latch module 20 locks the gating signal at this time, so as to control corresponding switch branches to be turned on, and fix the third direct current voltages VCC3 having corresponding voltage values at this time. The third direct current voltages VCC3 having corresponding voltage values at this time are optimal reference voltages, that is, VCOM, of the liquid crystal panel. In the display device of the present application, structures such as the multi-voltage conversion module 10, the latch module 20, and the gating switch matrix in the fan-out area 100 are used to form a reference voltage generation circuit. The circuit has a simple structure and is easy to implement, thereby reducing high overall production costs of an electronic device. A reference voltage that can be generated by the reference voltage generation circuit without using a DVR and a mechanical VR is adjustable, and a display effect of a liquid crystal panel is more desirable. In addition, as the reference voltage is generated at the display device, it is not necessary to consider a correspondence problem in assembling a C-board and the liquid crystal panel, thereby facilitating subsequent transportation and installation.

Figure 2:
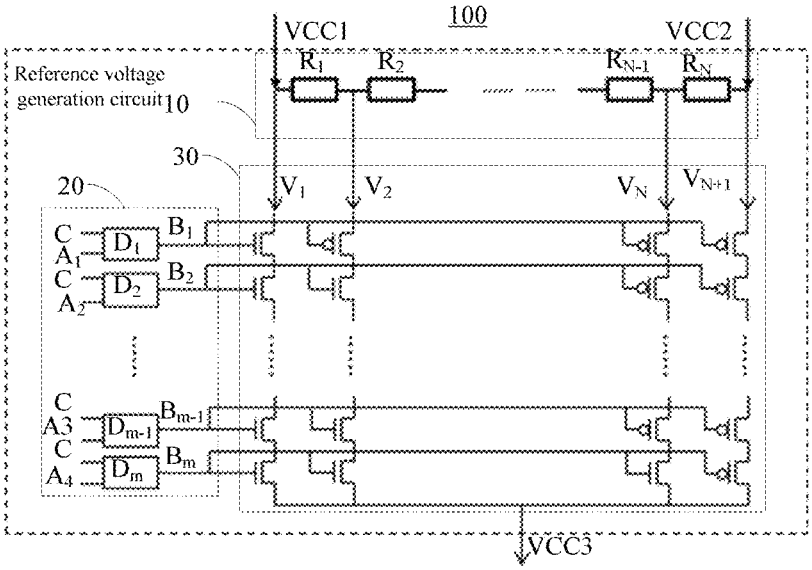
FIG. 2 is a circuit diagram of a reference voltage generation circuit in the display device in FIG. 1.

Referring to FIG. 2, in an optional embodiment, the multi-voltage conversion module 10 includes N voltage divider resistors, which are, as shown in FIG. 2, R1, R2, . . . , RN−1, and RN. The voltage divider resistors R1, R2, . . . , RN−1, and RN have a same resistance value, and are sequentially connected in serial between first input ends and second input ends of the multi-voltage conversion module 10.

In this embodiment, a plurality of voltage divider resistors is resistors that are in the fan-out area 100, formed by using a same process, and have a same resistance value. Because the voltage divider resistors and other modules of the display device are formed by using a same process, no additional costs are caused and the implementation is easy. The N voltage divider resistors having a same resistance value are sequentially connected in serial between the first input end and the second input end, and equally divide a difference value between the first direct current voltage VCC1 and the second direct current voltage into N+1 voltage values and output the N+1 voltage values as third direct current voltages VCC3. It should be understood that the plurality of voltage divider resistors mainly has a voltage divider effect. In another embodiment, the voltage divider resistors may be implemented by using discrete elements, which is not limited herein.

Referring to FIG. 2, furthermore, in the foregoing embodiment, the quantity of the switch branches is N+1, and each of the N+1 switch branches has M serially connected switching tubes, so as to form the gating switch matrix 30 having M rows and (N+1) columns, where $N=2^M-1$.

In this embodiment, the quantity of the switch branches corresponds to the quantity of the serially connected voltage divider resistors. For example, when there are N voltage divider resistors, there are N+1 switch branches. For the N+1 switch branches, M*2M switching tubes form a gating matrix, and are controlled based on the latch module 20. When switch control signals output by the latch module 20 are received, corresponding switch branches are turned on, and other switch branches are controlled to be in an off state, so as to implement a gating function and output the third direct current voltages VCC3 having corresponding voltage values.

In this embodiment, the switching tube is optionally an N-type insulated-gate field-effect transistor (N-MOSFET) and/or a P-type insulated-gate field-effect transistor (P-MOSFET).

Referring to FIG. 2, furthermore, in the foregoing embodiment, the latch module 20 includes M latches, as shown in FIG. 2, D1, D2, . . . , DM−1, and DM. Output ends of the latches are connected to controlled ends of the switching tubes that are located in a same row as the gating switch matrix 30 in one-to-one correspondence.

In this embodiment, the M latches respectively and correspondingly control corresponding rows of a plurality of switch branches to turn on/off switching tubes at the same locations, so as to implement that under the control of the M latches, only one switch branch is completely turned on, and the third direct current voltages VCC3 having corresponding voltage values are output.

Referring to FIG. 2, furthermore, in the foregoing embodiment, the latches output the corresponding switch control signals by using a binary code principle to control the switching tubes in the corresponding switch branches to be turned on.

In this embodiment, as shown in FIG. 2, each latch has two input ends, namely, a first input end C and a second input end A (A1, A2, . . . , AM−1, and AM), which are respectively used to input latch signals and gating signals having a logic high level/low level. When the latch signal input by the first input end C is a logic level H (high level), a switch control signal output by an output end B (B1, B2, . . . , BM−1, and BM) of a latch is a gating signal input by the second input end A at this time. When the latch signal is a logic level L (low level), the output end B maintains a state of previous switch-control-signal output, and a gating signal at this time fails. In this way, a working principle of a binary decoder is used to output corresponding switch control signals, to control corresponding switch branches to be turned on, so as to output the third direct current voltages VCC3 having corresponding voltage values.

Referring to FIG. 1, based on the foregoing embodiment, the display device further includes an S-COF (not shown) and a G-COF (not shown). The S-COF is connected to the display area 200.

In this embodiment, the S-COF is configured to convert a data signal provided by a TCON IC on the C-board into an analog signal and outputs the analog signal to the display area 200, that is, the liquid crystal panel. The G-COF is configured to provide a turn on/off signal to pixel electrodes in the liquid crystal panel, so as to control the liquid crystal panel to work.

To better describe the concept of the present application, specific principles of the reference voltage generation circuit of the present application are described below with reference to FIG. 3 and FIG. 4.

Figures 3, 4:
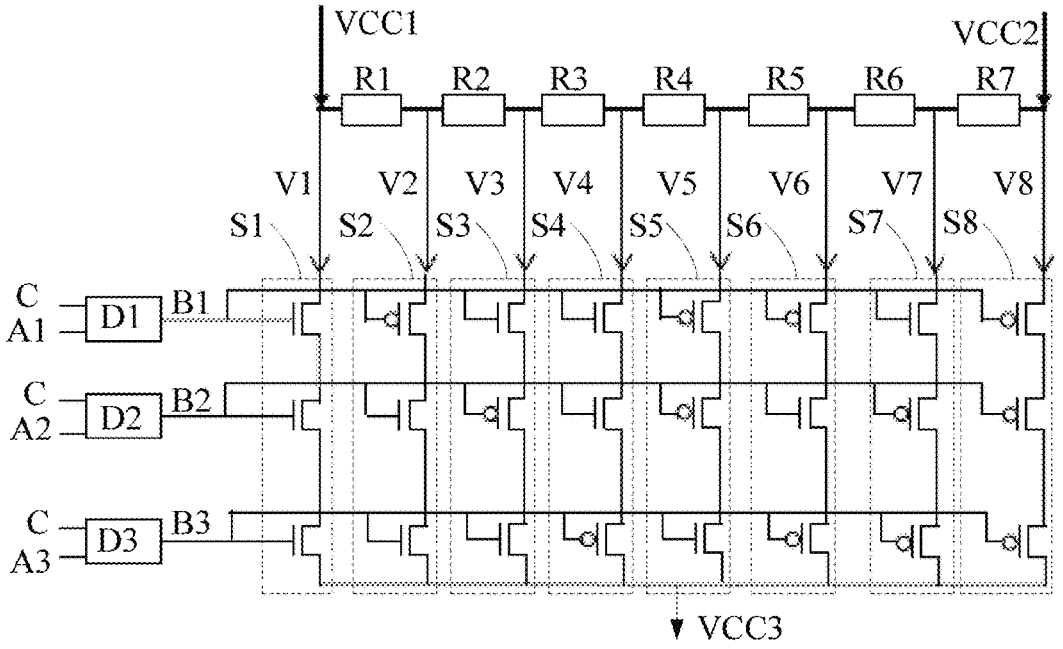
FIG. 3 is a specific circuit diagram in an embodiment of a reference voltage generation circuit in FIG. 2.
FIG. 4 is a truth table of a switch control signal corresponding to the output of a third direct current voltage of the reference voltage generation circuit in FIG. 3.

As shown in FIG. 3 and FIG. 4, FIG. 3 shows a specific circuit when the reference voltage generation circuit in an embodiment of the present application has three orders. FIG. 4 is a truth table of a switch control signal corresponding to the output of a third direct current voltage VCC3 of the reference voltage generation circuit in FIG. 3. In FIG. 3, the quantity of latches is 3, and the latches are D1, D2, and D3. The quantity of the corresponding voltage divider resistors is 7, which are resistors R1, R2, R3, R4, R5, R6, and R7. A difference value between the first direct current voltage VCC1 and the second direct current voltage is equally divided into voltage values V1, V2, V3, V4, V5, and V6 to be output. There are switch branches in the gating switch matrix 30, which are S1, S2, S3, S4, S5, S6, S7, and S8, and respectively output third direct current voltages VCC3 whose voltage values are V1, V2, V3, V4, V5, V6, V7, and V8. S1 is sequentially formed of an N-MOS transistor, an N-MOS transistor, and an N-MOS transistor group from top to bottom. S2 is sequentially formed of a P-MOS transistor, an N-MOS transistor, and an N-MOS transistor from top to bottom. S3 is sequentially formed of an N-MOS transistor, a P-MOS transistor and an N-MOS transistor from top to bottom. S4 is sequentially formed of an N-MOS transistor, an N-MOS transistor, and a P-MOS transistor from top to bottom. S5 is sequentially formed of a P-MOS transistor, a P-MOS transistor, and an N-MOS transistor from top to bottom. S5 is sequentially formed of a P-MOS transistor, an N-MOS transistor, and a P-MOS transistor from top to bottom. T S7 is sequentially formed of an N-MOS transistor, a P-MOS transistor, and a P-MOS transistor from top to bottom. S7 is sequentially formed of a P-MOS transistor, a P-MOS transistor, and a P-MOS transistor from top to bottom. When latch signals input by first input ends C of the latches D1, D2, and D3 are a logic level H (high level), switch control signals output by the output ends B1, B2, and B3 at this time are gating signals input by the second input ends A1, A2, and A3, that is, A1=B1, A2=B2, and A3=B3. At this time, inputs by the second input ends A1 to A3 are adjusted. If a voltage value of VCOM at this time is V2, the LCD screen has a minimum flickering degree, that is, the panel has the optimal performance. At this time, the first input ends C are switched to a logic level L (low level), B1 to B3 maintain logic levels L, H, H. The switch branch S2 is turned on. Voltages output by the output ends of the gating switch matrix 30 are V2. The rest is deduced by analogy. The latches use the output ends B1, B2, and B3 to output three switch control signals to control the P-MOSFET/N-MOSFET to be turned on, so as to control corresponding switch branches to be turned on and control voltage output of eight third direct current voltages VCC3 having corresponding voltage values V1 to V8, so as to complete the adjustment of the reference voltage.

It should be understood that the foregoing display device may be a cathode ray tube (CRT) display device, an LCD, a plasma display panel (PDP) display device, and an organic light-emitting diode (OLED) display device. The present application is optionally a TFT-LCD among LCDs.

The present application further provides a reference voltage generation method.

Figure 5:
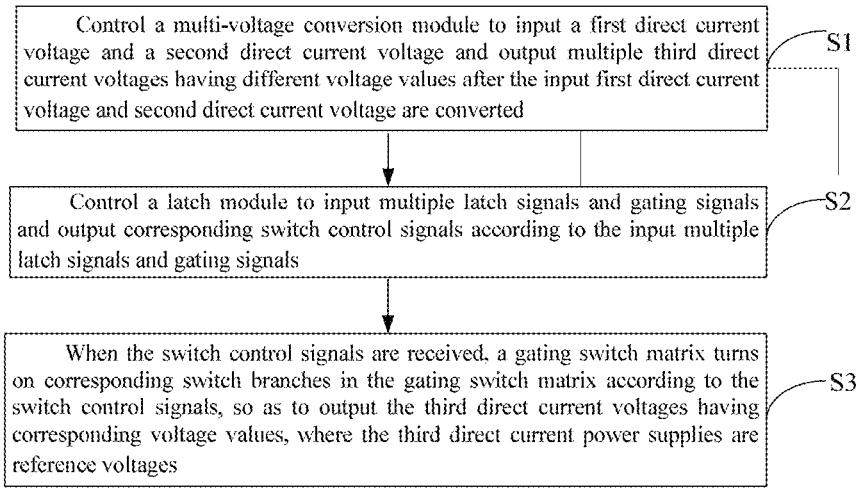
FIG. 5 is a flow chat of a reference voltage generation method in an embodiment of the present application.

Referring to FIG. 5, the reference voltage generation method includes the following steps:

S1: Control a multi-voltage conversion module to input a first direct current voltage and a second direct current voltage, and output multiple third direct current voltages having different voltage values after the input first direct current voltage and second direct current voltage are converted.

Thereinto, the multi-voltage conversion module uses N voltage divider resistors to equally divide a difference value between the first direct current voltage and the second direct current voltage into N+1 voltage values and output the N+1 voltage values as the third direct current voltages.

S2: Control a latch module to input multiple latch signals and gating signals and output corresponding switch control signals according to the input multiple latch signals and gating signals.

Thereinto, when the latch signal is a first level signal, a switch control signal output by an output end of the latch module is a gating signal input this time, and when the latch signal is a second level signal, the output end maintains a previous switch-control-signal output state, and a gating signal at this time fails.

Moreover, the latch module uses M latches to respectively and correspondingly control corresponding rows of a plurality of switch branches to turn on/off switching tubes at the same locations.

S3: When the switch control signals are received, a gating switch matrix turns on corresponding switch branches in the gating switch matrix according to the switch control signals, so as to output the third direct current voltages having corresponding voltage values, where the third direct current voltages are reference voltages.

Thereinto, N+1 switch branches are used for implementation, and each of the N+1 switch branches has M serially connected switching tubes, so as to form the gating switch matrix having M rows and (N+1) columns, where $N=2^M-1$.

This embodiment further provides an electronic device. The electronic device includes a circuit board and the foregoing display device. For the detailed structure of the display device, reference may be made to the foregoing embodiments, and details are no longer described herein. It should be understood that because the foregoing display device is used in the electronic device of the present utility model, an embodiment of the electronic device of the present utility model includes all technical solutions in all the foregoing embodiments of the display device, and the achieved technical effects are identical. Details are no longer described herein. The circuit board is connected to a display area of the display device through a fan-out area of the display device.

In this embodiment, the electronic device may be an electronic device having a display screen, for example, a television, a computer, and a mobile phone, and is not limited herein.

The foregoing is merely preferred embodiments of the present application and does not constitute a limitation on the patent scope of the present application. Any equivalent structure change made under the application concept of the present application by using the content of the specification and the accompanying drawings of the present application, or direct or indirect application thereof in other related technical fields, shall still fall in the protection scope of the patent of present application.

What is claimed is:

1. A display device, comprising:

a display area, a fan-out area, and a reference voltage generation circuit formed in the fan-out area, wherein the reference voltage generation circuit comprises:

a multi-voltage conversion module, configured to: input a first direct current voltage and a second direct current voltage, and output multiple third direct current voltages having different voltage values, wherein the first direct current voltage and the second direct current voltage are both larger than zero;

a latch module, configured to: input multiple latch signals and gating signals, and output corresponding switch control signals according to the input multiple latch signals and gating signals; and a gating switch matrix, having a plurality of switch branches for controlling output of the multiple third direct current voltages, configured to: turn on corresponding switch branches according to the switch control signals when the switch control signals are received, so as to output the third direct current voltages having corresponding voltage values, wherein the multi-voltage conversion module comprises N voltage divider resistors which are sequentially connected in serial between first input ends and second input ends of the multi-voltage conversion module, the N voltage divider resistors divide a difference value between the first direct current voltage and the second direct current voltage into N+1 voltage values and output the N+1 voltage values as the third direct current voltages, a quantity of the switch branches is N+1, and each of the N+1 switch branches has M serially connected switching tubes, so as to form the gating switch matrix having M rows and (N+1) columns, wherein N=2M−1, in response that the latch signals are at a first level, the latch module outputs a gating signal input as a switch control signal, and in response that the latch signals are at a second level, the latch module outputs a previous switch control signal as the switch control signal.

2. The display device of claim 1, wherein the multi-voltage conversion module comprises: a first input end, a second input end, and a plurality of output ends;

the latch module comprises a plurality of first input ends, and the first input end and the second input end of the multi-voltage conversion module are respectively configured to input the first direct current voltage and the second direct current voltage;

each of the switch branches comprises an input end, an output end, and a controlled end;

the latch module comprises the plurality of first input ends, a plurality of second input ends, and a plurality of output ends; and the plurality of output ends of the multi-voltage conversion module are connected to the input ends of the plurality of switch branches in one-to-one correspondence; the output ends of the plurality of switch branches are configured to output the third direct current voltages having corresponding voltage values; the plurality of first input ends of the latch module are configured to input latch signals, the plurality of second input ends of the latch module are configured to input gating signals, and the plurality of output ends of the latch module are connected to the controlled ends of the plurality of switch branches in one-to-one correspondence.

3. The display device of claim 1, wherein the voltage divider resistors have a same resistance value.

4. The display device of claim 1, wherein the latch module comprises M latches disposed corresponding to the M rows of the gating switch matrix, and output ends of the latches are connected to controlled ends of the switching tubes that are located in a same row as the gating switch matrix in one-to-one correspondence.

5. The display device of claim 4, wherein the latches output the corresponding switch control signals by using a binary code principle to control the switching tubes in the corresponding switch branches to be turned on.

6. The display device of claim 1, wherein the display device further comprises a source-chip on film (S-COF) and a gate-chip on film (G-COF), and the S-COF and the G-COF are connected to the display area.

7. A reference voltage generation method, comprising the following steps:

controlling a multi-voltage conversion module to input a first direct current voltage and a second direct current voltage and output multiple third direct current voltages having different voltage values after the input first direct current voltage and second direct current voltage are converted, wherein the first direct current voltage and the second direct current voltage are both larger than zero;

controlling a latch module to input multiple latch signals and gating signals and output corresponding switch control signals according to the input multiple latch signals and gating signals; and when the switch control signals are received, turning on, by a gating switch matrix, corresponding switch branches in the gating switch matrix according to the switch control signals, so as to output the third direct current voltages having corresponding voltage values, wherein the third direct current voltages are reference voltages, wherein the multi-voltage conversion module comprises N voltage divider resistors which are sequentially connected in serial between first input ends and second input ends of the multi-voltage conversion module, the N voltage divider resistors divide a difference value between the first direct current voltage and the second direct current voltage into N+1 voltage values and output the N+1 voltage values as the third direct current voltages, a quantity of the switch branches is N+1, and each of the N+1 switch branches has M serially connected switching tubes, so as to form the gating switch matrix having M rows and (N+1) columns, wherein N=2M−1, in response that the latch signals are at a first level, the latch module outputs a gating signal input as a switch control signal, and in response that the latch signals are at a second level, the latch module outputs a previous switch control signal as the switch control signal.

8. The reference voltage generation method of claim 7, wherein the latch module uses M latches to respectively and correspondingly control corresponding rows of a plurality of switch branches to turn on/off switching tubes at the same locations.

9. A display device, comprising:

a display area, a fan-out area, and a reference voltage generation circuit formed in the fan-out area, wherein the reference voltage generation circuit comprises:

a multi-voltage conversion module, configured to: input a first direct current voltage and a second direct current voltage, and output multiple third direct current voltages having different voltage values, wherein the first direct current voltage and the second direct current voltage are both larger than zero;

a latch module, configured to: input multiple latch signals and gating signals, and output corresponding switch control signals according to the input multiple latch signals and gating signals; and a gating switch matrix, having a plurality of switch branches for controlling output of the multiple third direct current voltages, and configured to: when the switch control signals are received, turn on corresponding switch branches according to the switch control signals, so as to output the third direct current voltages having corresponding voltage values, wherein the multi-voltage conversion module comprises N voltage divider resistors which are sequentially connected in serial between first input ends and second input ends of the multi-voltage conversion module, and the N voltage divider resistors are resistors that are in the fan-out area, are formed by using a same process, and have a same resistance value, wherein the N voltage divider resistors divide a difference value between the first direct current voltage and the second direct current voltage into N+1 voltage values and output the N+1 voltage values as the third direct current voltages, a quantity of the switch branches is N+1, and each of the N+1 switch branches has M serially connected switching tubes, so as to form the gating switch matrix having M rows and (N+1) columns, wherein N=2M−1, in response that the latch signals are at a first level, the latch module outputs a gating signal input as a switch control signal, and in response that the latch signals are at a second level, the latch module outputs a previous switch control signal as the switch control signal.

* * * * *